United States Patent [19]

Shibata

[11] Patent Number: 4,475,991

[45] Date of Patent: Oct. 9, 1984

[54] METHOD OF DIFFUSION CLADDING A FE-CONTAINING BASE MATERIAL FOR DECORATIVE ARTICLES AND ORNAMENTS WITH PRECIOUS METAL CONSTITUENTS INCLUDING AG

[75] Inventor: Akira Shibata, Yokohama, Japan

[73] Assignee: Chugai Denki Kogyo K.K., Japan

[21] Appl. No.: 479,022

[22] Filed: Mar. 25, 1983

[51] Int. Cl.[3] ..... C25D 5/10; C25D 5/50; C23B 5/52

[52] U.S. Cl. ..... 204/15; 204/37.1; 204/40; 204/43 R; 427/261; 427/287; 427/376.8; 427/383.9; 427/405

[58] Field of Search ..... 204/15, 37 R, 40, 43 G, 204/43 N, 43 R; 427/376.8, 383.9, 405, 259, 261, 287

[56] References Cited

U.S. PATENT DOCUMENTS

| | | | |
|---|---|---|---|
| 1,104,842 | 7/1914 | Smith | 204/37 R |
| 1,906,689 | 5/1933 | Ledig | 204/37 R |
| 3,251,121 | 5/1966 | Prival | 204/37 R |
| 3,698,880 | 10/1972 | Koons et al. | 204/37 R |
| 3,725,219 | 4/1973 | Wesoloski | 204/37 R |
| 4,309,461 | 1/1982 | Shibata | 427/259 |

*Primary Examiner*—G. L. Kaplan
*Assistant Examiner*—William T. Leader
*Attorney, Agent, or Firm*—Shlesinger, Fitzsimmons & Shlesinger

[57] ABSTRACT

The overlaying of a Fe-containing metallic material such as stainless steel which constitutes an anti-abrasive and sweat-proof base for decorative articles and ornaments, with a precious metal alloy such as a gold 18 carats fine which contains Ag is made by at least two steps, viz.; a first step which comprises plating selected surfaces of the base material with the constituents of said alloy but excluding Ag constituent in any desired order and one at a time in a plurality of first successive layers, and heating said first layers to cause them to diffuse to each other and with the base material; and a second step which comprises plating said surfaces further with all or selected ones of the constituents of said alloy and including the primary and Ag constituents in any desired order and one at a time in a plurality of second successive layers, and heating the second layers to cause them to diffuse to each other and with the first layers.

1 Claim, No Drawings

METHOD OF DIFFUSION CLADDING A FE-CONTAINING BASE MATERIAL FOR DECORATIVE ARTICLES AND ORNAMENTS WITH PRECIOUS METAL CONSTITUENTS INCLUDING AG

BACKGROUND OF THE INVENTION

This invention relates to a method of overlaying or more specifically diffusion cladding a Fe-containing metallic base material for decorative articles and ornaments with an alloy of Au, Pt, and/or Pd bases.

The present inventor has invented a method of the above-mentioned kind, and obtained U.S. Pat. No. 4,309,461 of Jan. 5, 1982, in which there is described a method of overlaying an austenite stainless steel material for decorative articles and ornaments with an alloy of Au, Pt, and/or Pd bases, which comprises plating selected surfaces of the steel material with the constituents of said alloy in any desired order, and one at a time in a plurality of successive layers, and with each layer being of a thickness and volume which corresponds to the constituent ratios of the alloy of a desired purity and dimension, and heating the layers to a temperature sufficient to cause them to liquid phase alloy.

It is now found by him that the alloy of Au, Pt, and/or Pd bases which is overlaid on an ingot stainless steel material for fabricating decorative articles and ornaments such as spectacle frames, watch casings, and watch bracelets by the aforementioned method, does not sometimes have hermetically sealed bonds with the steel material. And, boundaries between the alloy and the steel material sometimes discolor on account of sweat which passes into the boundaries. Sometimes, the alloy comes off partly from the base material. This is because that when an alloy of the aforementioned kind is heated, its diffusion into the stainless steel occurs, while constituents of stainless steel such as Fe, Cr, Ni and others, and particularly Fe which are activated by Au, Pd and/or Pt under an elevated temperature come up into the alloy, too. This Fe which diffuses into the alloy, forms metallurgically emulsion with Ag in the alloy, which emulsion gives, when it is cooled, fissility to the interfacial boundaries between the base steel material and the precious metal alloy cladded onto said base.

BRIEF SUMMARY OF THE INVENTION

In view of the above, this invention is to provide a novel method for diffusion cladding a Fe-containing base material for decorative articles and ornaments with a precious metal alloy, in which the cladding is made by two steps, first step of which does not employ Ag as an constituent of the said alloy. Diffusion bound interfaces between the base metal and the precious metal alloy are free from discoloration and rust.

DETAILED DESCRIPTION OF THE INVENTION

This invention is further explained in detail hereinunder with reference to the following example.

Example

An elongated strip of stainless steel (SUS 316L—containing Cr (18%), Ni (12%), and others, and of low carbon content) was treated with hydrofluoric acid to clean its surface. The upper surface of this strip was electrolytically plated successively and one at a time by Ni, Au, and Cu in this order. This layers had a total thickness of 7μ, in which Au was 75%, Ni 15%, and Cu 10% respectively by weight. The strip thus plated was subjected to a heat treatment at 950° C. in a furnace of a hydrogen atmosphere so that the plated layers were diffused to each other and with the stainless steel. The strip was rolled so that it reduced of its thickness by 10%, and then annealed at 950° C. Thus, the first layers plated on the steel base and diffused to each other had a thickness of 6.3μ of a gold alloy corresponding to gold 18 carats fine or 2N-18 gold alloy which contains 75 weight % of Au.

The strip was again electrolytically plated successively and one at a time by Ag and Au which formed the second layers of 3.7μ in total, in which Au was 75 weight % and Ag 25 weight %. This strip was placed again the the furnace of a hydrogen atmosphere of 700° C., whereby the second layers were diffused to each other and to the first layers.

The strip was finely polished at its upper surface.

The steel strip which was thus diffusion cladded by 10μ of gold 18 carats fine, was subjected tests of (1) twisting 180° for four times, (2) bending 90° with the plated surface up, and (3) immersing into synthetic sweat for two weeks at a room temperature. Results of the tests (1) and (2) did not show any physical change of the strip, and the test (3) did not give any rust.

I claim:

1. A method of diffusion cladding a Fe-containing metallic material for decorative articles and ornaments with a silver-containing precious metal alloy, which comprises a first step of plating selected surfaces of the metallic material with the constituents of said alloy, including at least one of the metals selected from the group consisting of Au, Pt, and Pd, but excluding Ag, in any desired order and one constituent at a time in a plurality of first successive layers, heating said first layers to cause them to diffuse to each other and to the metallic material; a second step of plating said surfaces further with all or selected constituents of said alloy, including said one metal and Ag, in any desired order and one constituent at a time in a plurality of second successive layers, and heating said second plurality of layers to cause them to diffuse to each other and to the first layers.

* * * * *